US006886723B2

(12) United States Patent
Manini

(10) Patent No.: US 6,886,723 B2
(45) Date of Patent: May 3, 2005

(54) METHOD AND DEVICE FOR STRETCHING SOCKS, KNEE SOCKS AND THE LIKE ON STEAMING FORMS

(75) Inventor: Benito Manini, Florence (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 10/103,094

(22) Filed: Mar. 21, 2002

(65) Prior Publication Data

US 2002/0179652 A1 Dec. 5, 2002

(30) Foreign Application Priority Data

Mar. 21, 2001 (IT) ..... PI2001A0024

(51) Int. Cl.[7] ..... D06C 5/00
(52) U.S. Cl. ..... 223/75
(58) Field of Search ..... 223/76, 75

(56) References Cited

U.S. PATENT DOCUMENTS 1,373,694 A * 4/1921 Witherell ..... 223/76
4,515,299 A * 5/1985 Sewell et al. ..... 223/76
5,605,260 A * 2/1997 Olivas Coll ..... 223/76

* cited by examiner

*Primary Examiner*—John J. Calvert
*Assistant Examiner*—James G Smith
(74) *Attorney, Agent, or Firm*—Simpson & Simpson, PLLC

(57) ABSTRACT

A method and a device for stretching hosiery articles such as socks, knee socks and the like comprises a steaming form having a straight portion opposite a foot shape. The steaming form has a friction surface for engaging the band portion of a sock and means for varying the friction surface so as to engage the sock for steaming and release the sock after steaming. The friction surface generally comprises a plate having a plurality of holes, a plurality of retractable tangs that communicate with the holes, and means for reciprocating the retractable tangs with respect to the holes. In this manner the tangs are operatively arranged to hook the band portion of a sock when they protrude from the holes and leave the sock free to slide on the plate when they are retracted. The reciprocation between plate and sheet causes the movement of the tangs to protrude or to retract with respect to the holes.

12 Claims, 5 Drawing Sheets

Fig. 1A
prior art
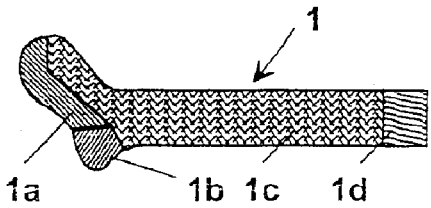
Fig. 1B
prior art
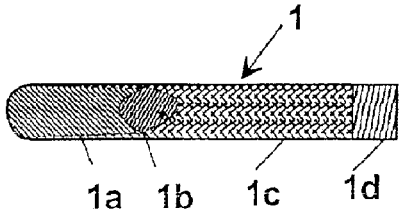
Fig. 2
prior art
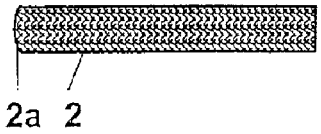
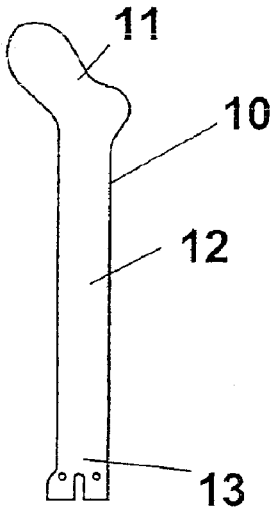
Fig. 3
prior art
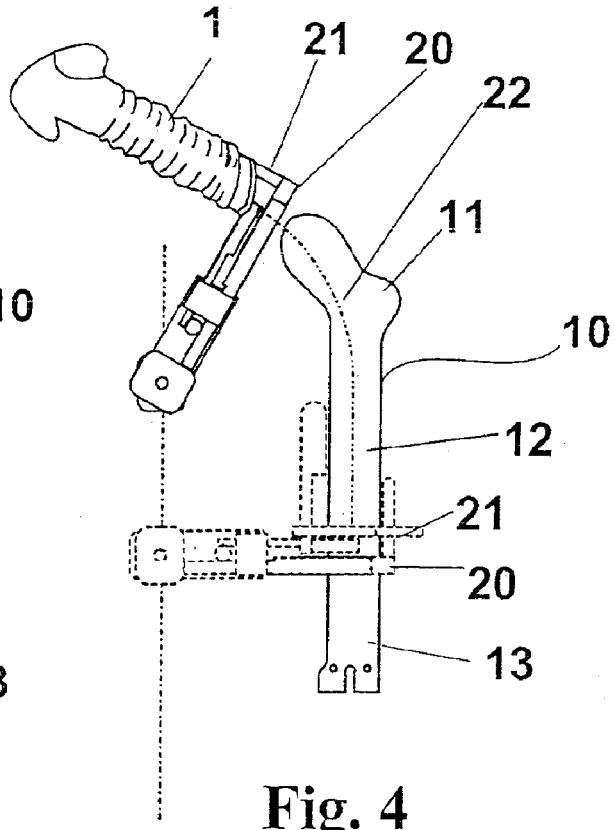
Fig. 4
prior art

METHOD AND DEVICE FOR STRETCHING SOCKS, KNEE SOCKS AND THE LIKE ON STEAMING FORMS

CROSS REFERENCE TO RELATED APPLICATIONS

This application for claims priority of Italian Patent Application No. IT2001PI00024, which was filed on Mar. 21, 2001.

FIELD OF THE INVENTION

The present invention relates to a method and device for stretching socks, knee socks and the like on steaming forms during a loading step on automatic steaming apparatus of such articles.

BACKGROUND OF THE INVENTION

In the manufacture of socks, knee socks and hosiery it is often necessary for the items to be steamed in order to provide a foot shaped appearance to the article, or for providing ease during the packaging process. Steaming of such items can be conducted either manually or automatically by means of steaming forms, which hold the articles to be steamed. The steaming forms generally comprise two flat forms placed in parallel relationship with one another and have an anatomical correct profile, with each form comprising a foot portion and a heel portion. While a regular sock is generally axially asymmetrical, owing to the presence of the foot portion and the heel portion, a knee sock is different, and comprises a tubular shape which has a seam along a curve at one end. In both cases, the portion of the sock opposite the foot is typically called the band portion, which comprises an elastic fiber band; the foot and band portions are generally connected by a tubular knitted portion.

Generally, both types of sock have to be placed on the steaming forms such that they rest in the plane of the form and correspond to the shape of the form. In the case of regular socks, the foot typically fits the form and is stretched to reach a natural profile. However, in the case of knee socks, the form of the foot and of the heel portion of the sock is determined during the steaming step.

Regular socks or knee socks can be loaded on steaming forms either automatically or manually and both types of sock are generally placed on the steaming form starting from an unstretched condition. In the case of automatic loading, holding tools can be used so that the socks can be stretched transversally. Typically, a holding tool in an open position engages the steaming form to first place the foot of the sock on the form. The holding tool then moves translationally to progressively stretched the tubular portion of the sock along the form. Eventually, the sock is placed and stretched on the form and the band portion is released from the holding tool. After the sock has been stretched upon the form the holding tool releases the sock and exits the loading zone.

Shortly after the sock has been released from the holding tool, there is a tendency for the sock to unstretch due to the elasticity of the sock material. The sock, thus, tends to slide along the smooth surface of the steaming form. The unstretching of the sock to its pre-stretched configuration is undesirable and causes flawed steaming of both the tubular portion, and the band portion of the sock. Unstretching of the sock on the form can also cause an irregular sock profile, which can lead to problems during packaging.

BRIEF SUMMARY OF THE INVENTION

It is therefore object of the present invention to provide a method for stretching socks, knee socks and the like on steaming forms on an automatic steaming apparatus.

It is another object of the present invention to provide a device for carrying out this method.

According to a preferred embodiment, the sock, after having been widened transversally from an unstretched condition, is placed on a steaming form in order to first place the foot of the sock onto the form, the sock is then progressively stretched along the tubular portion to reach a maximum extended condition where it engages a friction surface provided on the form at the height near the band portion, the friction surface being capable of releasing the band portion at the end of the steaming step so as to easily the remove the sock.

In a preferred embodiment, the friction surface comprises sharp elements oriented in a direction opposite that which the sock slides upon the form during loading so as to engage the band portion, the sharp elements being retractable and generally facing the opening of the sock when the sock is stretched. In addition, the friction surface engages with the band portion of the sock on both sides of the form, so as to hold the sock symmetrically and uniformly on the form.

In a preferred embodiment, the steaming form has a fastening portion which is secured to as support, the fastening portion is joined or connected to a straight portion of the form that ends with the shape of a foot, the straight portion opposite the foot shape has a friction surface for engagement with the band portion of the sock and means for varying the friction surface for releasing the band portion at the end of the steaming step in order to easily remove the sock.

In the preferred embodiment the friction surface of the present invention comprises:

a plate having a plurality of holes;

a plurality of retractable tangs that engage with the holes;

means for reciprocating the retractable tangs with respect to the holes, whereby the tangs hook the band portion of the sock when they protrude from the holes and leave it free to slide on the plate when they are retracted.

Preferably, the retractable tangs are formed on a sheet which is placed parallel to the plate surface and opposite to the friction surface such that the tangs communicate with the plate holes. Reciprocation between the plate and the sheet cause the tangs to protrude or to retract with respect to the holes. The holes of the plate are elongated and inclined at an angle in order to provide proper orientation and ease the sliding of the tangs.

In a preferred embodiment, the fastening portion of the form is separate from the steaming form and comprises:

parallel sheaths formed each by a plate having a plurality of holes and by a counter-plate, the plate and the counter-plate being joined at the edges but spaced in order to define a recess, the sheaths having a first fastening end portion for the forms and a second fastening end portion for a support, the two plates being arranged at the external sides of the sheaths and the two counter-plates being arranged at the inner sides of the sheaths in order to define between them a fastening housing of the forms;

sheets sliding in the recesses, the sheets having a plurality of tangs that engage with the holes, the sheets having an end portion from the side of the fastening portion; and, means for moving the end portion to cause the sheets to slide in the sheaths.

The means for moving the end portion generally comprise a cam portion connected to an actuator wherein the end portion has a pin that protrudes from the sheath and engages with the cam, whereby movement of the actuator causes a corresponding sheet movement.

The cam portion is preferably a plate having a cam-shaped hole wherein the pin engages.

BRIEF DESCRIPTION OF THE DRAWINGS

Further characteristics and advantages of the method and of the apparatus according to the present invention, for stretching socks, knee socks and the like on steaming form, will be more fully described in the following detailed description and by reference to the attached drawings in which:

FIGS. 1A and 1B show side and bottom views of a regular sock, respectively;

FIG. 2 shows a view of a knee sock;

FIGS. 3 and 4 show steaming forms and apparatus for hosiery articles according to the prior art and a step of automatic load of a sock on said form;

DETAILED DESCRIPTION OF THE PREFERRED EMBODIMENTS

Figure 5:
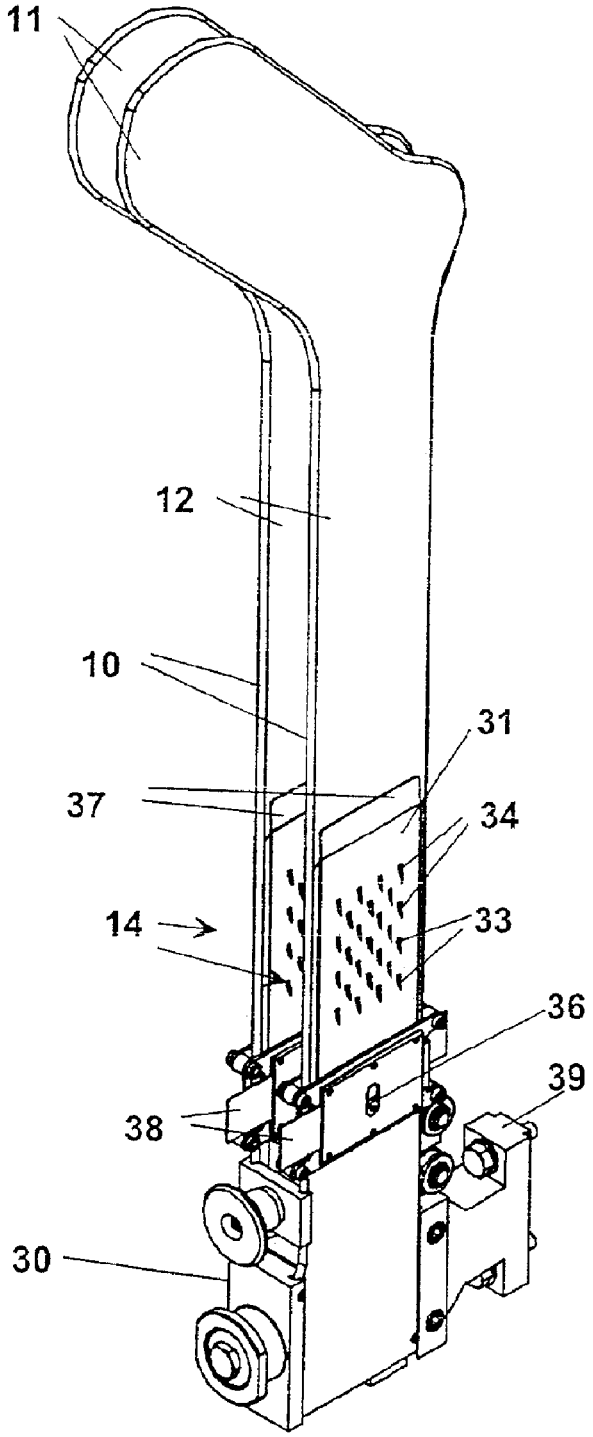
FIGS. 5 and 6 show perspective and elevational side views of steaming forms comprising the device for stretching socks according to the present invention.

In the detailed description that follows, reference is made to a method and apparatus for loading socks on steaming forms, it should, however, be appreciated by those having skill in the art that although the present invention is intended to comprise methods and devices for loading socks, other hosiery related articles are contemplated.

With reference to FIGS. 1A and 1B, a regular sock generally comprises different knitted zones having a foot 1*a*, a heel 1*b*, a leg 1*c* and the band 1*d*. With reference to FIG. 2, a knee sock 2, or tubular sock, typically comprises a knitted tubular portion and an end seam 2*a*. The foot shape of a tubular sock is not necessarily knitted, but rather, is created when steamed on steaming forms.

As shown in FIGS. 3 and 4, the form of a sock 1, and in a similar fashion, the form of a knee sock 2, can be fixed by placing it on a steaming form 10. Steaming forms generally known in the art typically comprise a fastening portion 13, which is fastened to a support (not shown) and an elongated straight portion 12, that begins at the fastening portion 13 and ends with the foot portion 11. Form 10 can be loaded manually or, as shown in FIG. 4, automatically by means of a loading unit 20, which widens an unstretched sock 1 by means of holding tool 21. The holding form follows trajectory 22 to place the sock completely on form 10.

Figure 6:
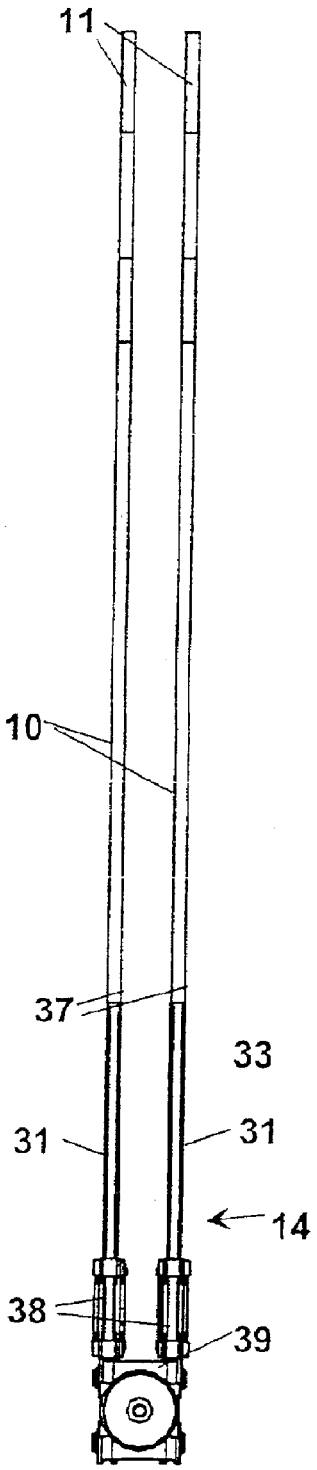

As shown in FIGS. 5 and 6, the device of the present invention comprises straight portion 12, which is opposite to foot shape 11, and friction surface 14 for engagement with band portion 1*d* of a sock. Friction surface 14 generally comprises plate 31 and sheet 32, as more clearly shown in FIGS. 7, 8, 12A, 12B, 13 and 14. Plate 31 comprises a plurality of holes 33 which are operatively arranged at an angle, or incline, for communication with retractable tangs 34, which are formed on sheet 32. Sheet 32 maintains parallel relationship with plate 31 and the relative reciprocation of plate 31 with respect to sheet 32 causes tangs 34 to protrude or to retract with respect to holes 33. Holes 33 of plate 31 are elongated and inclined at an angle 33*a* in order to properly orient the sliding of the plates and maintain proper communication between tangs 34 and holes 33.

Fastening portion 30 of the steaming form of the present invention comprises two halves—plate 31 and a counter-plate 37. Plate 31 and counter-plate 37 are joined at the edges and operatively arranged so as to define a sliding sheath for sheet 32. Two plates 31 are typically arranged so as to comprise external sides of the sheaths and two counter-plates 37 are arranged so as to define the inner sides of the sheaths. Counter-plates 37 also comprise a means for attaching fastening portion 30 to the steaming forms.

Figure 7:
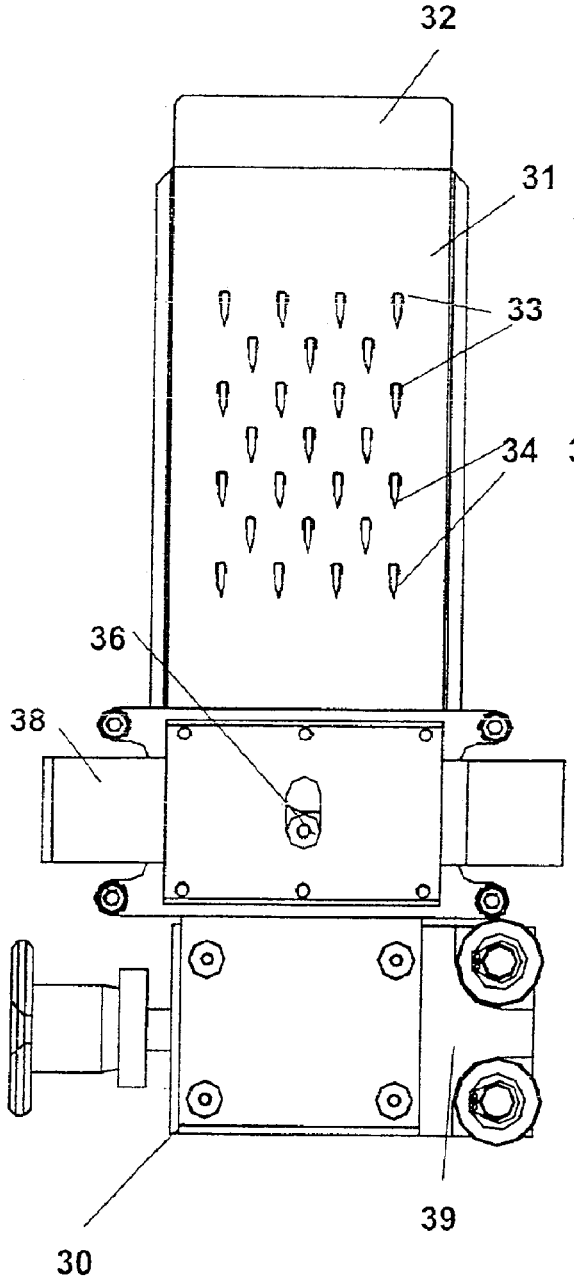
FIGS. 7 and 8 show elevational side and front views of the device for stretching socks according to the present invention.
Figure 8:
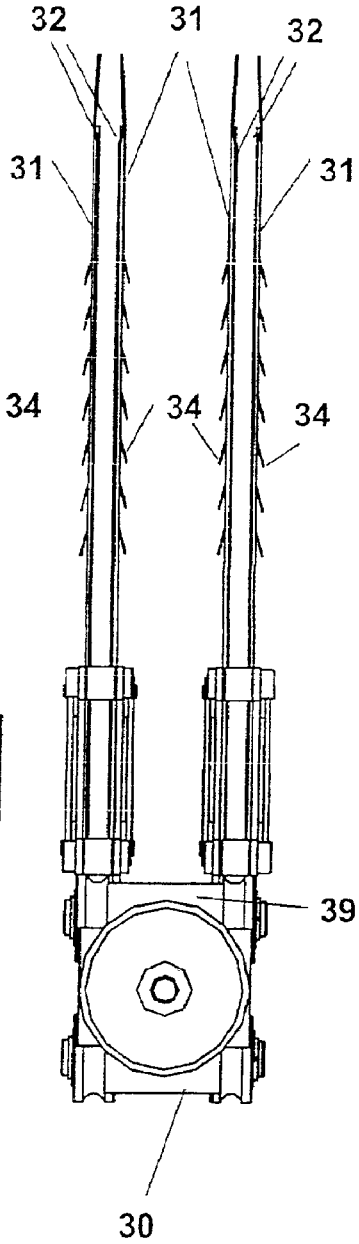
Figure 9:
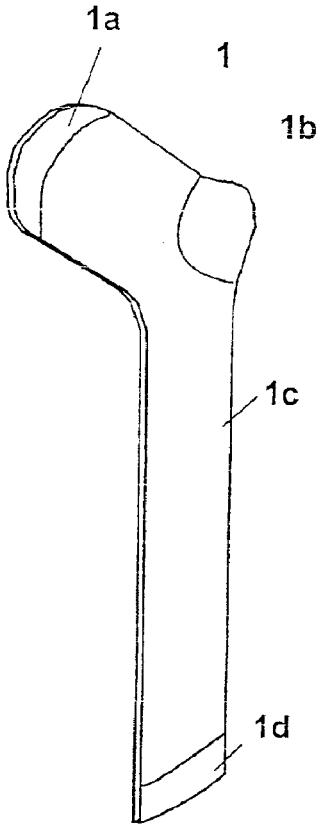
FIGS. 9, 10 and 11 show perspective views of a regular sock; a regular sock loaded on a steaming form of the present invention, and a regular sock released from the steaming form of the present invention.
Figure 10:
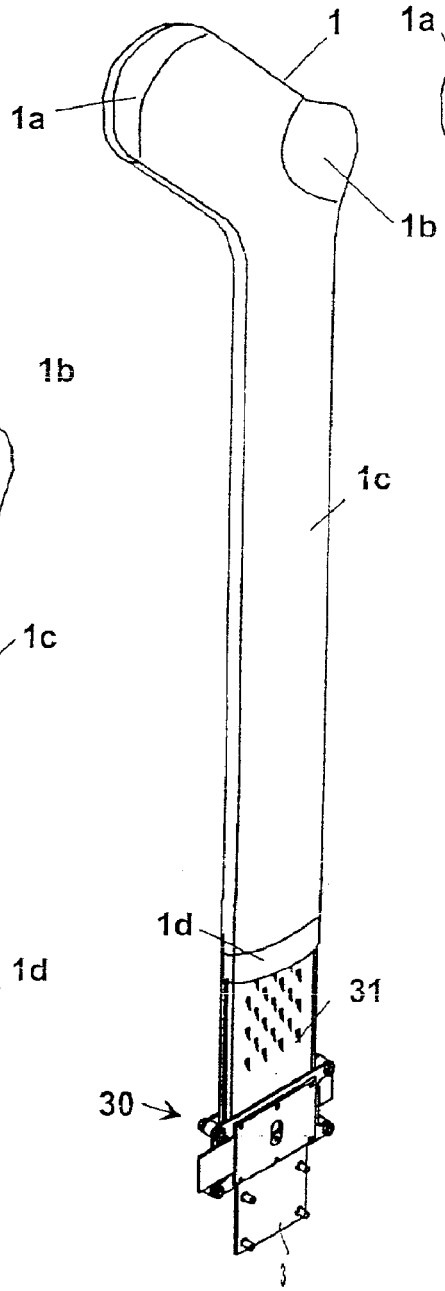
Figure 11:
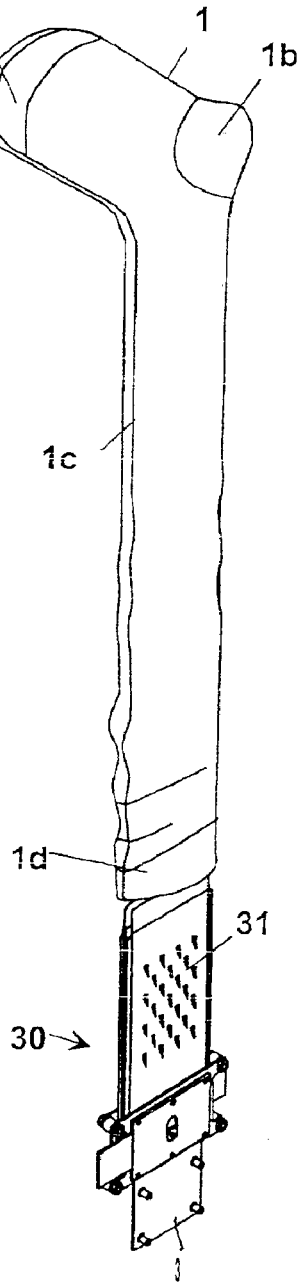
Figure 12A:
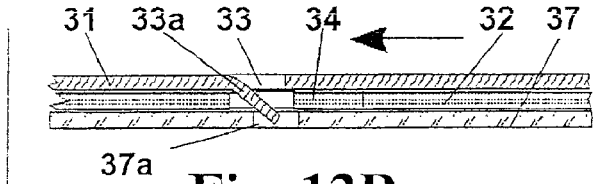
FIGS. 12A and 12B show detailed movement of the sheet of the present invention comprising retractable tangs.
Figure 12B:
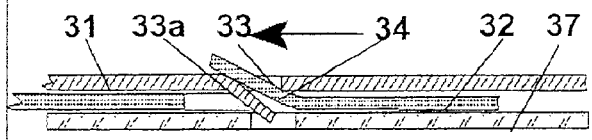
Figure 13:
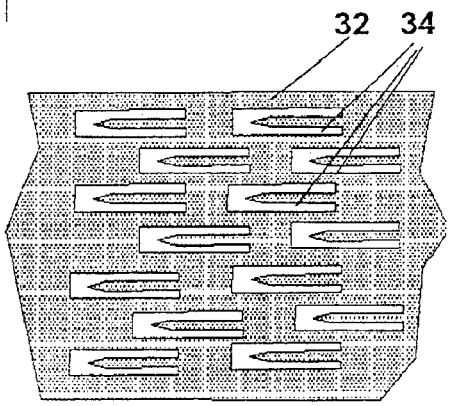
FIG. 13 shows a top view of the sheet comprising tangs.
Figure 14:
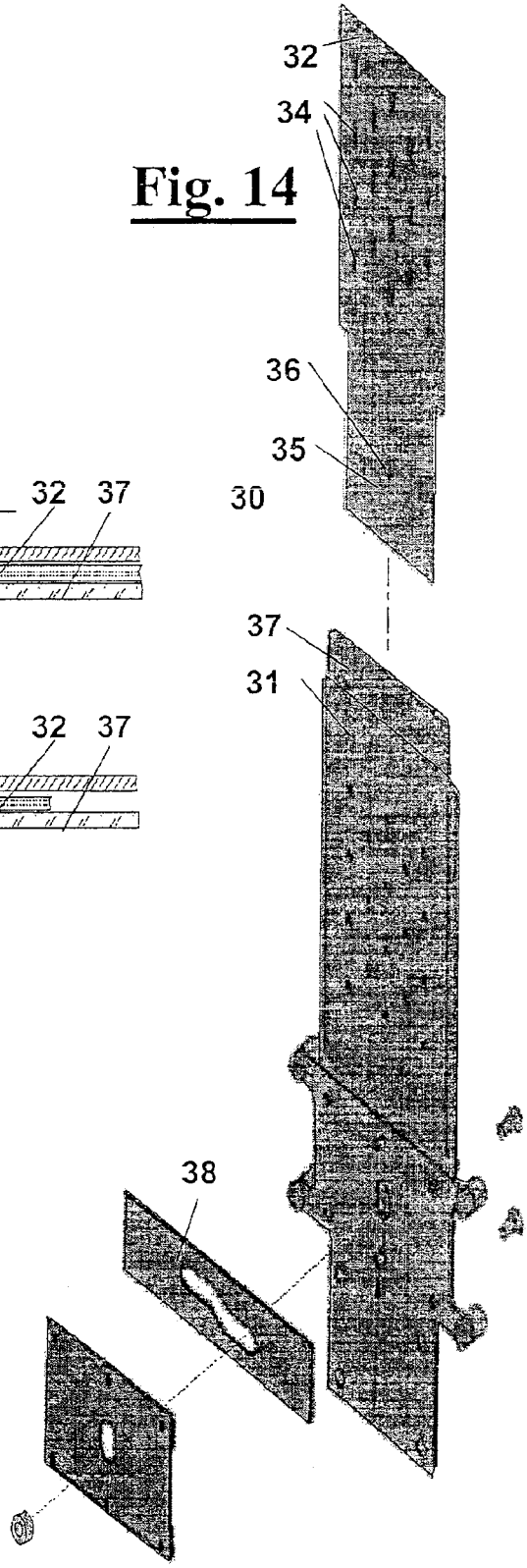
FIG. 14 shows an exploded view of the sheet and plate portions according to the present invention.

In order to properly reciprocate the retractable tangs 34 in and out of holes 33, so that the tangs can engage (FIGS. 10 and 12B) and disengage (FIGS. 11 and 12A) the band portion of a sock, it is necessary to move end portion 35 (FIG. 14) of sheet 32 by means of actuating pin 36. Movement of end portion 35 by means of actuating pin 36 is accomplished by engagement of actuating pin 36 by means of cam 38, which is connected to an pneumatic actuator 39 (FIG. 7). Thus, the horizontal movement of pneumatic actuator 39 causes corresponding movement of cam 3, which acts upon pin 36 of sheet 32 to cause movement between the two positions shown in FIGS. 12A and 12B. It should be appreciated that other actuators, other than pnuematic, are contemplated by the present invention.

Thus, to steam socks according to the present invention the socks are first widened transversally using a holder known in art. They are then placed on the steaming form by first placing the foot portion of the sock upon the form. The sock is then progressively stretched along tubular portion 1*c* to reach an extended condition near band portion 1*d*. Prior to stretching the sock to its extended position, friction surface 30 maintains a smooth configuration wherein tangs 34 maintain a retracted position. Upon extension of the sock, friction surface 30 is activated via pneumatic actuator, to cause tangs 34 to protrude through holes 33 and to engage sock so as to maintain the extended position. The sock is then steamed and upon completion of steaming and drying of the sock, the tangs are retracted. It should be appreciated that after the steaming and drying steps, the sock maintains its stretched configuration because steaming and drying upon form 10 causes the fibers of the sock to relax in the extended configuration. Thus, the sock it configured and properly shaped for efficient packaging.

It should be appreciated, however, that although the foregoing detailed description discloses the preferred embodiment of the present invention, other embodiments, of the present invention are contemplated, which embodiments do not depart from the spirit and scope of the present invention. For instance, other means of engaging the socks may be employed and other means of causing protrusion and retraction of the tang means may be used. In addition, it should be further appreciated that the terminology employed herein is intended solely for the purposes of illustration and is not intended to limit the scope of the present invention to a particular embodiment or configuration.

What I claim is:

1. A method for stretching hosiery articles comprising the steps of:

placing a hosiery article on a steaming form comprising a tanged friction portion, said tanged friction portion comprising an outer steaming portion comprising a plurality of holes and an inner steaming portion comprising a plurality of retractable tangs adapted for communication with said holes;

stretching a tubular portion of said article to an extended position;

engaging said extended tubular portion by means of said tanged friction portion of said form;

steaming said article; and disengaging said tanged friction portion to release said article from said form.

2. The method of claim 1 wherein a band portion of said article is held on the form such that said retractable tangs are oriented towards the opening of the band portion in a direction that is opposite to that direction which the article is first placed on the form.

3. The method of claim 1 wherein said tanged friction portion engages with said band portion on the sides of said form, such that said article is symmetrically and uniformly held in place.

4. A device for stretching articles of hosiery upon a steaming form comprising:

an outer steaming form portion comprising a plurality of holes;

an inner steaming form portion comprising a plurality of retractable tangs communicating with said holes;

means for reciprocating said retractable tangs with respect to the holes, whereby said retractable tangs engage said articles of hosiery when they protrude from said holes and release said article when they are retracted.

5. The device of claim 4, wherein said steaming form comprises a fastening portion, said fastening portion comprising:

parallel sheaths each formed by a plate having a plurality of holes and a counterplate, the plate and the counterplate being joined at the edges to define a sliding recess, said sheaths having a first fastening end portion and a second fastening end portion, wherein said plates are arranged at the external sides of the sheaths and said counter-plates are arranged at the inner sides of the sheaths in order to define between them a fastening housing;

sheets for sliding in said recesses of said sheaths, said sheets having a plurality of tangs that communicate with holes of said plates, said sheets having an end portion;

means for causing sheet end portion movement so as to cause said sheets to slide and reciprocate within said sheaths.

6. The device of claim 5, wherein said means for causing movement comprises a cam portion connected to an actuator and said sheet end portion comprises means for engaging said cam, whereby the movement of said actuator causes a corresponding sheet movement.

7. The device of claim 6, wherein said cam portion is comprises a plate defining a recess, and said sheet end portion comprises a pin means, wherein said recess is operatively arranged for engagement with said pin means.

8. The device of claim 4 wherein said holes of said outer steaming form portion are elongated and inclined and said retractable tangs are complementarily inclined for communication therewith.

9. The device of claim 8 wherein said outer steaming form portion comprises a plate and said inner steaming form portion comprises a counter-plate.

10. The device of claim 9, wherein said retractable tangs are formed on said counter-plate, said counter-plate being parallel to said plate and operatively arranged for relative reciprocation between said plate and said counter-plate such that said retractable tangs protrude and retract with respect to said holes.

11. A method for stretching hosiery articles comprising the steps of:

placing a hosiery article on a steaming form, said steaming form comprising an outer steaming form portion comprising a plurality of holes and an inner steaming form portion comprising a plurality of retractable tangs communicating with said holes;

stretching a tubular portion of said hosiery article to an extended position;

engaging said tubular portion by means of a tanged friction surface; said tanged friction surface comprising said retractable tangs oriented towards the opening of said tubular portion in a direction that is opposite to that direction which the article is first placed on the form such that said hosiery article is secured upon said steaming form when said retractable tangs of said friction surface are in the engaged position;

steaming said article; and disengaging said tanged friction surface to release said article from said form.

12. A device for stretching a hosiery article upon a steaming form; said steaming form comprising:

a fastening portion;

a straight portion; and, an end portion in the shape of a foot;

wherein said straight portion comprising a friction surface for engaging said hosiery article, said friction surface comprising means for varying said friction surface, said means for varying said friction surface comprising:

a plurality of elongated and inclined holes;

a plurality of retractable tangs for communicating with said elongated and inclined holes; and, means for reciprocating said retractable tangs with respect to said elongated and inclined holes, whereby said tangs engage said hosiery article when said tangs protrude from said elongated and inclined holes and release said article when said tangs are retracted.

* * * * *